US006173763B1

(12) United States Patent
Sano et al.

(10) Patent No.: US 6,173,763 B1
(45) Date of Patent: Jan. 16, 2001

(54) HEAT EXCHANGER TUBE AND METHOD FOR MANUFACTURING A HEAT EXCHANGER

(75) Inventors: Tetsuo Sano, Shizuoka-ken; Hideaki Motohashi, Kanagawa-ken; Kokichi Furuhama, Tokyo, all of (JP)

(73) Assignee: Kabushiki Kaisha Toshiba, Kawasaki (JP)

( * ) Notice: Under 35 U.S.C. 154(b), the term of this patent shall be extended for 551 days.

(21) Appl. No.: 08/888,365

(22) Filed: Jul. 3, 1997

Related U.S. Application Data

(63) Continuation of application No. 08/544,765, filed on Oct. 18, 1995, now abandoned.

(30) Foreign Application Priority Data

Oct. 28, 1994 (JP) ..... 6-265523

(51) Int. Cl.[7] ..... F28F 13/18

(52) U.S. Cl. ..... 165/133; 165/184; 165/151; 62/324.6

(58) Field of Search ..... 165/184, 181, 165/179, 133, 10, DIG. 526, DIG. 525, DIG. 520, DIG. 518; 62/498, 324.6

(56) References Cited

U.S. PATENT DOCUMENTS

| | | | | |
|---|---|---|---|---|
| 3,710,586 | * | 1/1973 | Maudlin | 62/498 X |
| 3,750,709 | * | 8/1973 | French | 165/179 X |
| 4,044,797 | * | 8/1977 | Fujie et al. | 165/179 X |
| 4,480,684 | * | 11/1984 | Onishi et al. | 165/179 X |
| 4,638,858 | * | 1/1987 | Chu | 165/181 X |
| 4,658,892 | | 4/1987 | Shinohara et al. | 165/133 |
| 4,705,103 | * | 11/1987 | Zogg et al. | 165/179 X |
| 4,809,415 | * | 3/1989 | Okayama et al. | 165/133 X |
| 4,912,937 | * | 4/1990 | Nakamura et al. | 62/324.6 X |
| 4,977,953 | * | 12/1990 | Yamagishi et al. | 165/10 |
| 5,052,476 | * | 10/1991 | Sukumoda et al. | 165/179 X |
| 5,259,448 | * | 11/1993 | Masukawa et al. | 165/179 X |
| 5,275,234 | * | 1/1994 | Booth | 165/133 |
| 5,357,766 | * | 10/1994 | Shiraishi et al. | 62/498 X |
| 5,361,601 | * | 11/1994 | Han et al. | 62/324.6 |

FOREIGN PATENT DOCUMENTS

| | | | | |
|---|---|---|---|---|
| 0528801 | * | 4/1957 | (BE) | 165/184 |
| 0518312 | * | 12/1992 | (EP) | 165/184 |
| 0289293 | * | 12/1986 | (JP) | 165/179 |
| 0172893 | * | 7/1988 | (JP) | 165/179 |
| 4302999 | * | 10/1992 | (JP) | 165/179 |

OTHER PUBLICATIONS

30th National Heat Transfer Symposium of Japan, pp. 337–339, May 26, 1993.*

* cited by examiner

*Primary Examiner*—Christopher Atkinson
(74) *Attorney, Agent, or Firm*—Pillsbury Madison & Sutro LLP

(57) ABSTRACT

There is disclosed a heat exchanger tube for conducting refigerant in a heat exchanger. The inner surface of the tube has a convex portion having a broad tip and a plurality of inner fins. The area of the tip of the convex portion is larger than that of the tip of the inner fins. The height of the convex portion can be set at more than that of the inner fin. A heat exchanger according to the invention has a plurality of plate fins, each having a hole therein. Heat exchanger tubes pass through the holes of the plate fins. A method of manufacturing a heat exchanger comprises the steps of stacking a plurality of plate fins, each having a hole, with a predetermined space therebetween. Heat exchanger tubes are inserted through the holes. Then, the tubes are expanded to engage the plate fins. A refrigerating circuit utilizing a heat exchanger is also described.

15 Claims, 11 Drawing Sheets

HEAT EXCHANGER TUBE AND METHOD FOR MANUFACTURING A HEAT EXCHANGER

This is a continuation of application Ser. No. 08/544,765, filed on Oct. 18, 1995, which was abandoned upon the filing hereof.

BACKGROUND OF THE INVENTION

1. Field of Invention

The present invention relates in general to heat exchanger tubes used in the construction of heat exchangers, air conditioning and refrigeration systems having heat exchangers using heat exchanger tubes, and to methods of manufacturing heat exchangers. More specifically, the invention relates to the arrangement of the inner surface of heat exchanger tubes.

2. Description of Related Art

Typically, air conditioners and refrigerators have a refrigerating circuit including a compressor, an expansion valve and heat exchangers. Refrigerant is circulated through the refrigerating circuit by the compressor. The heat exchangers facilitate the exchange of heat between an outside fluid (usually air) and refrigerant flowing therethrough. It is desirable for the heat exchanger to achieve a high heat transfer coefficient so that the refrigerating circuit will operate with high efficiency. In other words, it is desirable to achieve high air conditioning capacity or refrigerating capacity with low energy consumption.

FIG. 12 (Prior Art) shows the general arrangement of a known heat exchanger. A plurality of heat exchanger tubes 103 pass through faceplate fins 101 made of a high thermal conductivity metal material such as an aluminum. Heat exchanger tubes 103 are also made of a high heat conductivity material that is easy to process, such as a copper. The refrigerant flowing in heat exchanger tube 103, indicated by the arrow in FIG. 12, exchanges heat with a fluid flowing the space between adjacent plate fins 101.

It is known to use chlorofluorocarbon refrigerant CFC12 (called "R12") and hydrochlorofluorocarbon refrigerant HCFC22) (called "R22") as the refrigerants for air conditioning and refrigeration systems. Generally, R12 is used in refrigerators and R22 is used in air conditioners. These refrigerants are so-called "single refrigerants" because they have a single boiling point. This property makes them stable in changing between liquid state and gaseous state. It is therefore easy to design systems using these refrigerants.

It has now become known that R12 is an environmental hazard. This refrigerant is chemically extremely stable in the atmosphere (doesn't break down) and tends to damage the earth's ozone layer. Even small amounts of R12 refrigerants which leak into the atmosphere, tend to accumulate in the ozone layer and damage it. Accordingly, R12 refrigerant has been designated as a specific Freon subject to regulations limiting its use. R22 refrigerant, on the other hand, decomposes in the atmosphere. It has far less potential for damaging the earth's ozone layer. However it does have some harmful effects. Therefore, it has been decided to limit the use of R22 as well.

Recently, HFC (hydrofluorocarbon) refrigerants which do not damage the ozone layer have been developed as substitutes for those which have been specifically designated to be harmful. Some of the recently developed Freons are:

1,1,1,2-tetrafluoroethane (R134a), pentafluoroethane (R125), 1,1,2,2-tetrafluoroethane (R134), 1,1,2-trifluoroethane (R143), 1,1,1 trifluoroethane (R143a) 1, 1-difluoroethane (R152a)

Inonofluoroethane (R161), etc.

The above-listed HFC refrigerants are single refrigerants. However, each of the HFC refrigerants has some disadvantages. For example, difluoromethane (R32) has a higher discharge pressure (and temperature) than that of R22 refrigerant. Unfortunately, a single HFC refrigerant having properties close to those of R12 or R22 has not yet been developed. Therefore, efforts have been made to develop a mixed HFC refrigerant, a mixture of two or more types of HFC single refrigerants that will work well in a refrigerating circuit.

Among the mixed refrigerants, R32/R125/R134a ("R407C") has properties somewhat similar to those of R22. However, all mixed refrigerants, including R407C, present a system design problem. Mixed refrigerants have multiple boiling points because each constituent refrigerant has its own boiling point that may be different from the boiling points of other constituents. Mixed refrigerants are therefore referred to as "zeotropic" refrigerants. When a zeotropic refrigerant evaporates in a heat exchanger, the refrigerant component having the lowest boiling point, for example in R407C, R32 has the lowest boiling point, evaporates first. At the same time, only a small amount of another constituent refrigerant in the mixture evaporates. Accordingly, when a heat exchanger is used as an evaporator, the high boiling point refrigerant constituent tends to remain in the heat exchanger, while the lower boiling point constituent evaporates. The constituent remaining in the heat exchanger tends to interfere with heat transfer of the heat exchanger, thus, the heat transfer coefficient is decreased. A problem also exists when the heat exchanger is used as a condenser. The low boiling point constituent tends to remain in the heat exchanger. Consequently, when a zeotropic refrigerant is used in refrigerating circuit, the heat transfer coefficient is decreased.

FIGS. 13 and 14 are graphs showing the heat transfer coefficients of a zeotropic refrigerant and single refrigerant. FIG. 13 depicts the heat transfer coefficients at the time of condensation and FIG. 14 shows the heat transfer coefficients at the time of evaporation. In both figures, the upper line is drawn through data points representing a single refrigerant while the lower line is drawn through data points representing a zeotropic refrigerant. As shown in the graphs, the zeotropic refrigerant has a lower heat transfer coefficient than that of a single refrigerant. Thus, refrigerating circuits using zeotropic refrigerant have a lower efficiency than those using a single refrigerant.

In an effort to overcome this problem it has been proposed to try to improve heat exchangers by improving their heat exchange tubes. The tubes have been provided with inner fins to improve their heat transfer coefficient. In this regard see U.S. Pat. No. 4,658,892—Shinohara et al. The inner surface of the tube disclosed therein has a number of spiral grooves defined by depth, shape and helix angle. The subject matter of U.S. Pat. No. 4,658,892 is hereby incorporated by reference as if fully set forth herein. Providing inner fins in the heat exchange tube increases its inner surface area touching the refrigerant which tends to increase its heat transfer coefficient.

FIG. 15 is a graph showing the improvement of heat transfer coefficient of a heat exchanger that can be achieved by using heat exchange tubes having inner fins. If the density of inner fins increases, the heat transfer coefficient of the heat exchanger is improved. However, there are practical problems associated with the manufacture of the heat exchange tubes and assembly of the tubes into the heat exchanger.

It is necessary to tightly connect the heat exchange tubes with the plate fins of the heat exchanger to increase its heat transfer coefficient. Generally, in manufacturing a heat exchanger, a plurality fins having holes are arranged parallel to each other, then the heat exchanger tubes are passed through the holes of the plate fins. After that, the heat exchanger tubes are expanded in a radial direction by inserting an expanding jig from one end of the heat exchanger tube. However, in a heat exchanger using inner fin heat exchanger tube, when the expanding jig is inserted, the inner fins on the surface of the heat exchanger tube are pushed in the radial direction by the expanding jig. As the result, the inner fins are mashed and deformed. This deformation decreases the inner surface area and reduces heat transfer efficiency. Also, the deformation may interfere with the flow of refrigerant in the tube. As flow resistance increases, refrigerant flow rate decreases. Refrigerant flow rate is one of the more important factors in determining refrigerating capacity and operating efficiency of the refrigerating circuit. When the flowing resistance increases, that is to say flowing speed of the refrigerant is decreased, the refrigerating capacity and the operation efficiency of the refrigerating circuit is decreased.

SUMMARY OF THE INVENTION

It is an object of this invention to provide an improved heat exchanger tube and an improved method for manufacturing a heat exchanger.

It is another object of this invention to provide an heat exchanger tube having a high heat transfer coefficient.

It is a further object of this invention to provide a heat exchanger tube that improves the refrigerating performance and efficiency of a refrigerating circuit in which it is installed.

It is a further object of this invention to provide a heat exchanger suitable for a refrigerating circuit using a zeotropic refrigerant.

It is a further object of this invention to provide an improved method for manufacturing a heat exchanger having a high heat transfer coefficient.

To achieve the above objects, the present invention provides a new arrangement for the inner surface of a heat exchanger tube that improves heat transfer efficiency and a method of manufacturing a heat exchanger using such tubes.

The inner surface of the heat exchanger tube has a convex portion having a tip, and a plurality of inner fins each having a tip. The area of the tip of each convex portion is larger than that of the inner fins. In one preferred embodiment, the ratio between the height of the inner fins, which is the distance from the tip of the inner fin to the inner surface of the heat exchanger tube, and a mean inner diameter of the heat exchanger tube, which is the distance between the center of the inner fin and the center of inner fin located at an opposite side of the tube through the center thereof, is greater than 0.035.

In another embodiment, the cross-sectional shapes of the convex portion and the inner fins are asymmetrical so that the flow resistances are different for different flow directions of a refrigerant through the tube. In an alternative embodiment, the height of the convex portion is more than that of the inner fin. The convex portion and the inner fins can be spiraled along inside of the heat exchanger tube, the spiral having a predetermined helix angle, preferably equal to or greater than 30°.

A preferred embodiment of the heat exchanger for a refrigerating circuit according to the present invention includes a plurality of plate fins, each having a hole therein; and a heat exchanger tube passing through the holes of the plate fins, the heat exchanger tube having a tube wall configured so as to have an outer surface and an inner surface having a convex portion having a tip which has a predetermined area, and a plurality of inner fins each having a tip, the area of the tip of the convex portion being larger than that of the tip of the inner fins. The tubes themselves would have characteristics as described above with respect to various embodiments.

The present invention also provides a refrigerating circuit including a compressor for compressing a refrigerant flowing in the refrigerating circuit; at least two heat exchangers for heat exchanging between the refrigerant and fluids external to the refrigerating circuit; and a expansion valve connected between the heat exchangers, at least one of the heat exchangers comprising: a plurality of plate fins, each having a hole therein; and a heat exchanger tube passing through the holes of the plate fins, the heat exchanger tube having the characteristics described above with respect to its various embodiments.

The present invention also provides methods for manufacturing a heat exchanger. A first manufacturing method includes the steps of:

stacking a plurality of plate fins, each of the plate fins having a hole, with a predetermined space therebetween;

inserting through the holes of the plate fins a heat exchanger tube having a tube wall configured so as to have an outer surface and an inner surface having a convex portion having a tip which has a predetermined area, and a plurality of inner fins each having a tip, the area of the tip of the convex portion being larger than that of the tip of the inner fins and the outer diameter of the heat exchanger tube being smaller than the diameter of the hole of plate fin; and expanding the heat exchanger tubes to engage the plate fins. The tubes themselves can have the various characteristics as described above with respect to the various tube embodiments.

A second manufacturing method includes two expansion steps. The expanding includes the steps of:

inserting into the tube a first expanding element having a diameter larger than that of the inside diameter of heat exchanger tube; and inserting into the tube a second expanding element having a diameter larger than that of the first expanding element.

The expanding can also be carried out using a tube. An alternative embodiment of the manufacturing method includes the steps of:

inserting into the heat exchanger tube a sleeve having a slit therein so that the diameter of the sleeve can expand; and inserting into the heat exchanger tube an expanding element having a diameter that is larger than the inside diameter of the sleeve.

BRIEF DESCRIPTION OF THE DRAWINGS

Preferred embodiments of the invention will described in greater detail with reference to the accompanying drawings wherein like reference numerals represent like or corresponding elements or steps throughout the drawings.

DETAILED DESCRIPTION OF PREFERRED EMBODIMENTS

Figure 1:
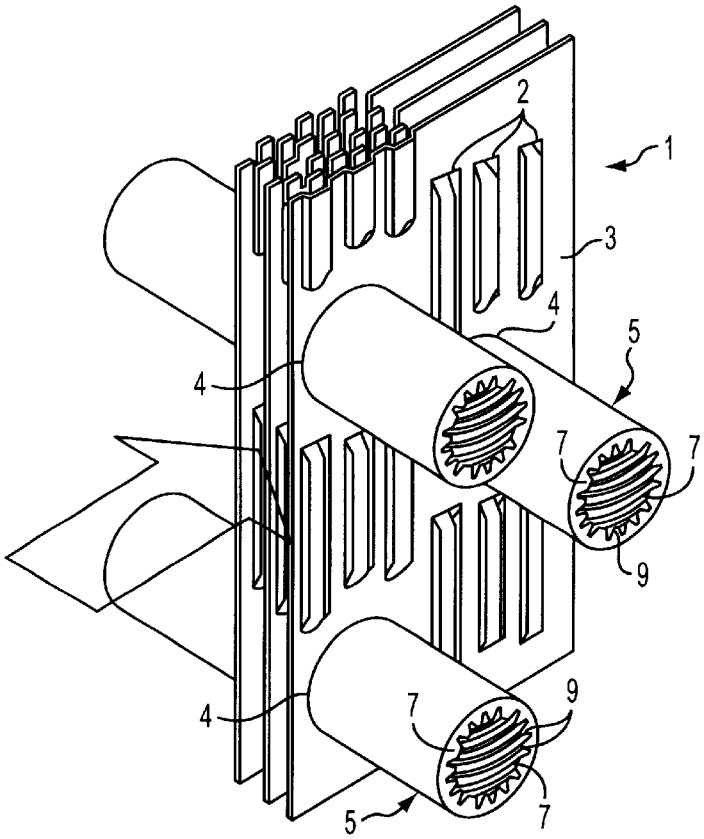
FIG. 1 is a perspective view of a portion of a heat exchanger according to the present invention.

FIG. 1 is a perspective view of a portion of a heat exchanger 1 according to the present invention. Heat exchanger 1 includes a plurality of plate fins 3 and inner fin heat exchanger tubes 5 passing through holes 4 of the plate fins 3. A plurality of slits 2 for improving heat transfer are provided between adjacent tubes 5 on each plate fin 3. The inner surface of each of tubes 5 is configured so as to have a plurality of trapezoid shaped convex portions 7 and a plurality of inner fins 9, as can be more clearly seen in FIGS. 2, 3, and 4. Several inner fins 9 are located between each pair of adjacent convex portions 7, 7. The cross-sectional shape of each inner fin 9 is a triangle. In this embodiment, convex portions 7 and inner fins 9 have the same height. Inner fin heat exchanger tube 5 is made of copper so as to have a high thermal conductivity. Each of inner fins 9 and convex portions 7 is formed as a spiral along the inner fin heat exchanger tube 1 by grooving from inside the tube 5. Tubes 5 are preferably made of a soft heat conductive metal such as copper which is easy to groove.

Figure 2:
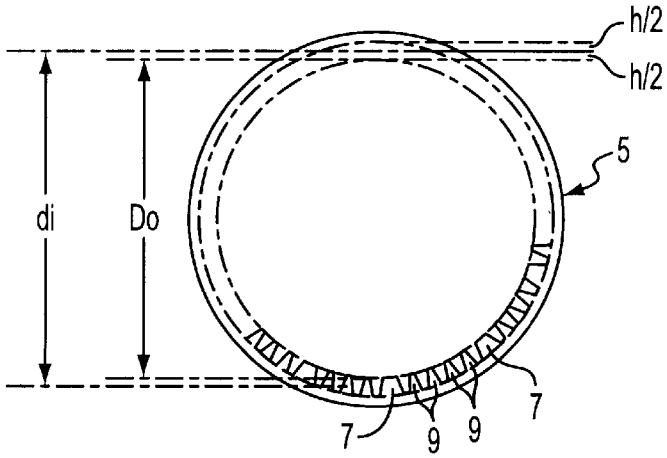
FIG. 2 is an enlarged cross sectional view of a heat exchanger tube 7, three of which are shown in FIG. 1.

FIG. 2 is an enlarged cross sectional view of a heat exchanger tube 5, three of which are shown in FIG. 1. As shown in FIG. 2, the ratio (h/di) of the height (h), or depth, of inner fins 9 to the mean inner diameter (di) which is the distance between the center of inner fin 7 and the center of inner fin 7 located at opposite side is set at more than 0.035.

Figure 3:
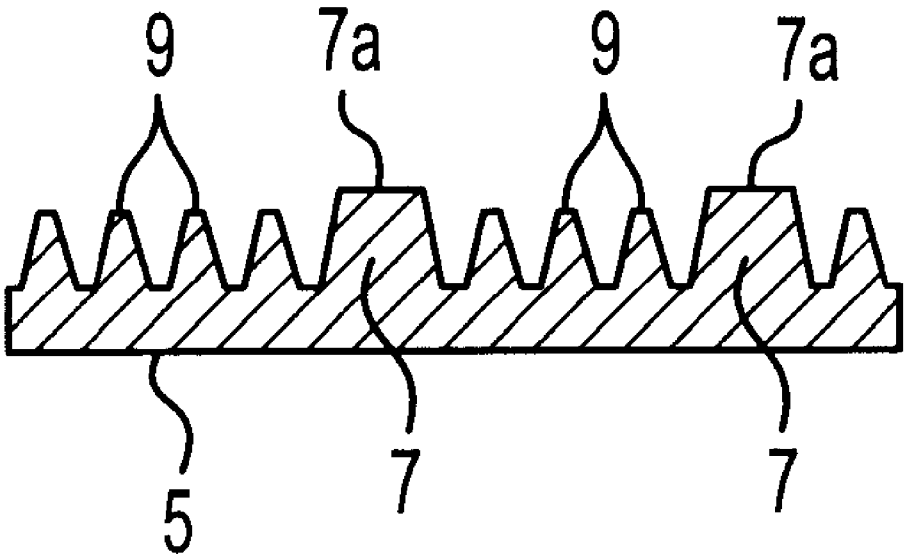
FIG. 3 schematically shows a portion of a heat exchange tube that has been flattened for more clear showing of the convex portions and fins.

FIG. 3 schematically shows a portion of a heat exchange tube that has been uncurled for more clear showing of the convex portions and fins.

Figure 4:
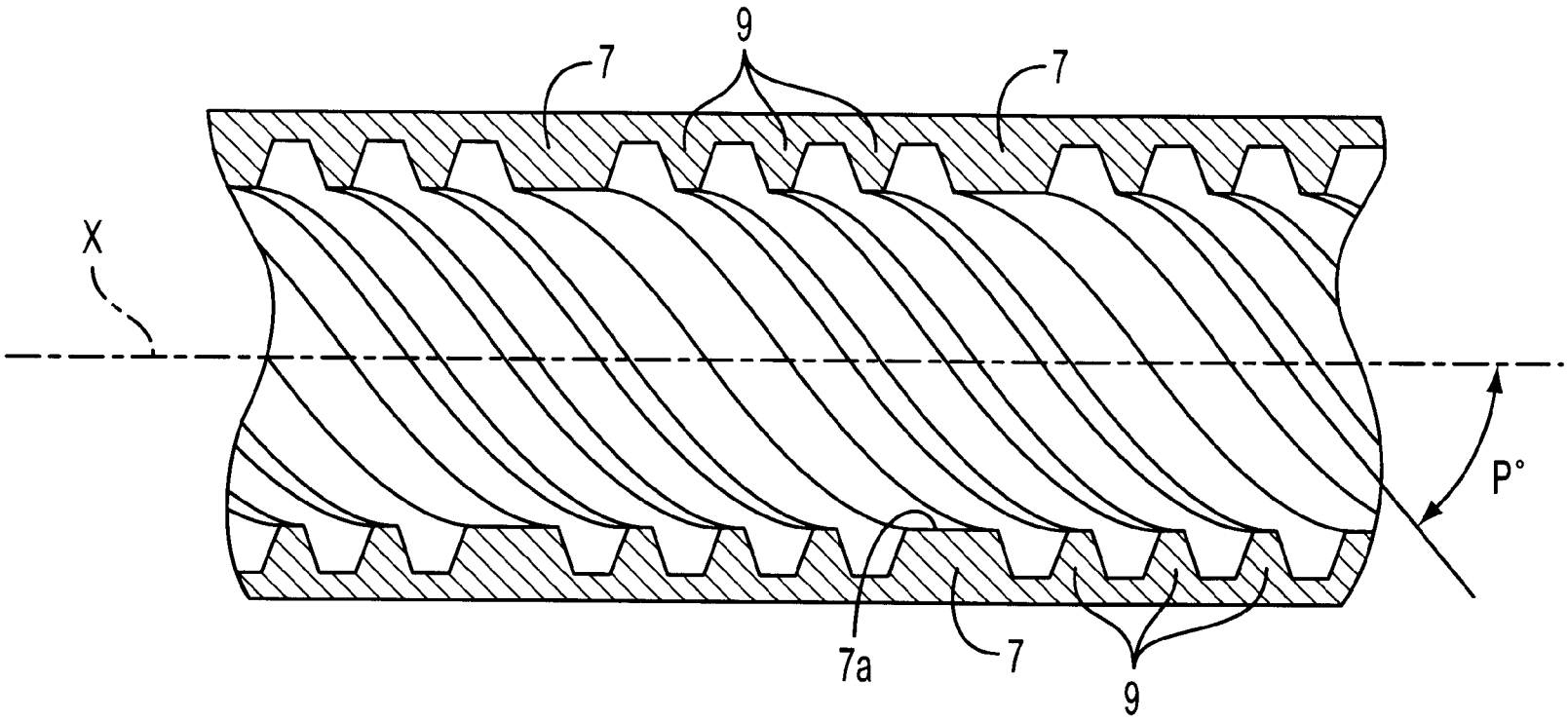
FIG. 4 is a schematic longitudinal cross sectional view of a heat exchange tube according to the present invention.

FIG. 4 is a longitudinal cross sectional view of the heat exchanger tube for illustrating the helix angle of the spiral. The helix angle β° of the spiral shape of fins 9 and convex portions 7, is arranged to be at least 30° (β≧30°), The tip 7*a* of trapezoidal convex portion 7 has a larger planer area than that of inner fin 9.

In this embodiment, inner fins 9 and convex portions 7 are continuously formed along the inner surface of tubes 5 as spirals, respectively. However, it is not necessary to form them continuously. Furthermore, the shapes of inner fins 9 and convex portions 7 are not limited to spirals, however, it may be straight along the longitudinal axis X (as in FIG. 4) of inner fin heat exchanger tube 5.

Figure 5:
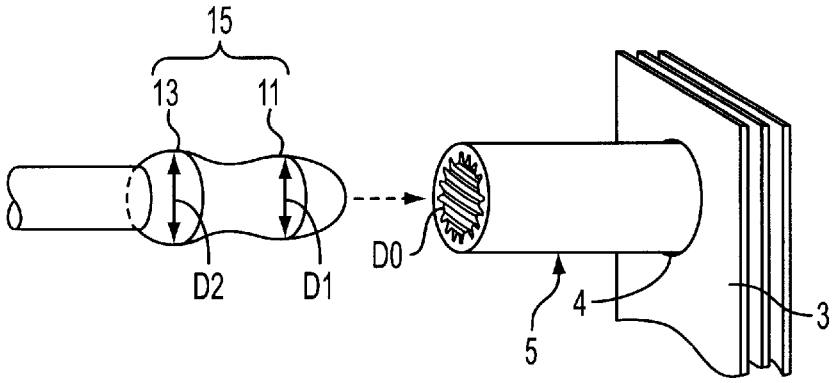
FIG. 5 is a schematic drawing explaining a portion of the method of manufacturing a heat exchanger in accordance with the present invention. It shows how the heat exchange tube is expanded after it has been passed through a holes in the fins.

FIG. 5 is a schematic drawing explaining a portion of the method of manufacturing a heat exchanger 1 in accordance with the present invention. It shows how the heat exchange tube is expanded after it has been passed through a holes in the fins. First, a plurality of plate fins 3 are stacked with narrow space therebetween so that holes 4 of each plate fin 3 are aligned. Stacked together plate fins 3 form a rectangular stack. Then, as shown in FIG. 5, inner fin heat exchanger tubes 5 are inserted into holes 4 provided at plate fins 3. The diameter of holes 4 is slightly larger than the outer diameter of inner fin heat exchanger tube 5 so that it is easy to insert tubes 5 into holes 4. After inner fin heat exchanger tubes 5 are inserted in holes 4, inner fin heat exchanger tubes 5 are expanded radially to insure a tight mechanical fit between inner fin heat exchanger tube 5 and plate fins 3.

The expanding is carried out by inserting an expanding jig 15 into inner fin heat exchanger tube 5 as shown in FIG. 5. Expanding jig 15 has a first expanding portion 11 which is located at the tip of it and second expanding portion 13 which is located at predetermined distance rear of first expanding portion in the inserting direction. The diameter D1 of first expanding portion 11 is slightly larger than the inner diameter D0 of inner fin heat exchanger tube 5 before expanding. The diameter D2 of second expanding portion 13 is larger than the diameter D1 of first expanding portion 11.

When expanding jig 15 is inserted into inner fin heat exchanger tube 5, inner fin heat exchanger tube 5 is expanded by first expanding portion 11, then inner fin heat exchanger tube 5 is expanded by second expanding portion 13. Accordingly, inner fin heat exchanger tube 5 is expanded twice by inserting one expanding jig 15. At this expanding, inner diameter D0 of inner fin heat exchanger tube 5 is expanded from D0 to D1 by first expanding portion 11, then, inner diameter is expanded from D1 to D2 by second expanding portion 13. As the result of this expanding, inner diameter D0 of inner fin heat exchanger tube 5 becomes D2. The outer diameter of inner fin heat exchanger tube 5 is expanded according to expand its inner diameter, thus inner fin heat exchanger tube 5 engages with plate fins 3.

When expanding jig 15 is inserted, the expanding force against the inner surface of inner fin heat exchanger tube 5 mainly pushes against tip 7*a* of convex portions 7 because the height of inner fins 9 and convex portions 7 are the same, although tip 7*a* of convex portions 7 has the sufficient area to receive the force. Therefore, the tips of fins 9 do not sustain significant damage of deformation or buckling by expanding. Furthermore, the expanding force is divided and equally applied to each convex portion 7 on the same circumference of inner fin heat exchanger tube 5. Therefore, tube 5 dose not deform at the time of expanding. For this purpose, as above described, the helix angle β° of convex portions 7 is made to be at least 30°, and it is better that at least one convex portions 9 is provided at the same circumference of inner fin heat exchanger tube 5. It is preffered that there are at least three convex portions 7 at the same circumference of inner fin heat exchanger tube 5. Accordingly, the expanding force is smoothly applied to each convex portion 7 in the longitudinal direction of heat exchanger 5, thus exchanger tube 5 is uniformly expanded in the same direction.

Furthermore, in this embodiment, the expanding is carried out twice. Thus, the expanding length of each expanding operation can be smaller than if expanding all at once. Accordingly, damage due to expanding inner fin heat exchanger tube 5 is minimal. By applying this expanding method to inner fin heat exchanger tube 5, it is possible to prevent inner fins 9 from deforming and buckling. Therefore, inner fin heat exchanger tube 5 having inner fins 9 in which the ratio (h/di) is more than 0.035 can be used as heat exchanger tube.

Figure 6:
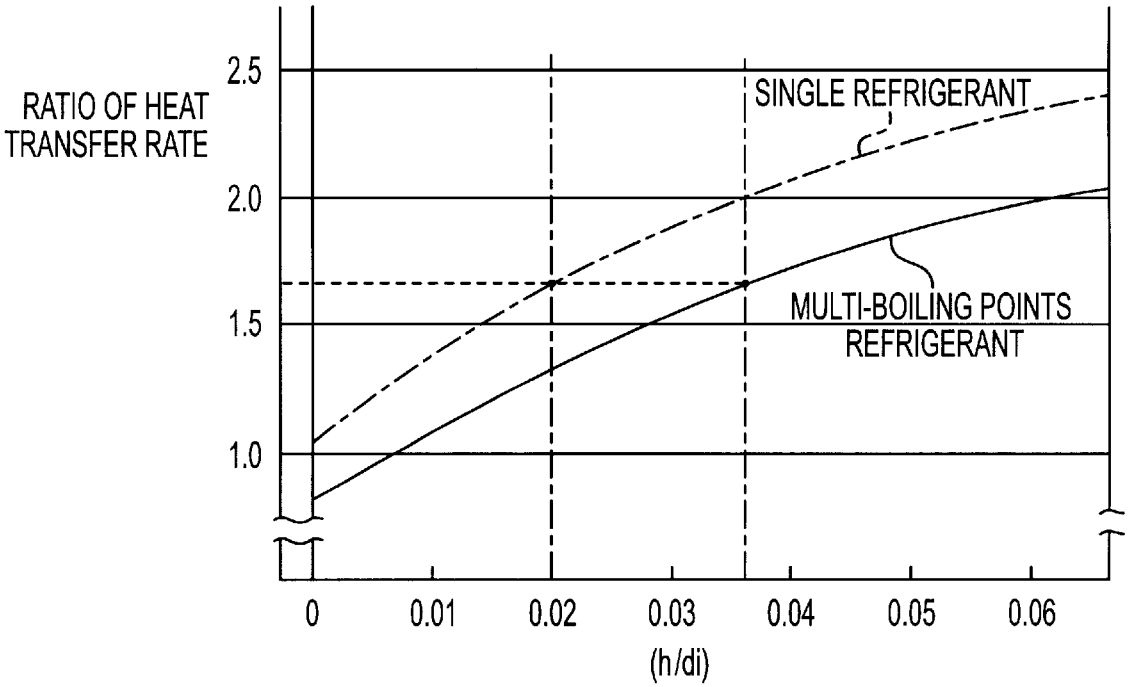
FIG. 6 is a graph showing a relationship between a ratio of height to inner diameter of the fins of the heat transfer tube and heat transfer coefficient.

FIG. 6 is a graph showing the relationship between the ratio (h/di) and the ratio of heat transfer rate of the heat exchanger. The ratio of heat transfer rate is defined that the heat transfer rate of an inner fin heat exchanger divided by the heat transfer rate of a non-inner fin heat exchanger with a single refrigerant. That is to say the ratio of heat transfer rate of using a non-inner fin heat exchanger with a single refrigerant is 1. When using a zeotropic refrigerant in a heat exchanger having an inner fin heat exchanger tube, and a ratio (h/di) of less than about 0.009, there is a lower heat transfer rate than that of a non-inner fin heat exchanger using a single refrigerant. In a refrigerating circuit using the single refrigerant, a heat exchanger having an inner fin heat exchanger tube, the ratio (h/di) of which is about 0.02, is ordinarily used. In this heat exchanger, the ratio of the heat transfer rate is about 1.6. Therefore, in a refrigerating circuit using the zeotropic refrigerant, also it is required that the rate of heat transfer ratio of the heat exchanger is more than 1.6. Consequently, the ratio (h/di) of heat exchanger having an inner fin heat exchanger tube for a refrigerating circuit using a zeotropic refrigerant is more than 0.035 in order to perform the heat transfer as the same as ordinary heat exchanger for a refrigerating circuit using the single refrigerant.

Figure 7:
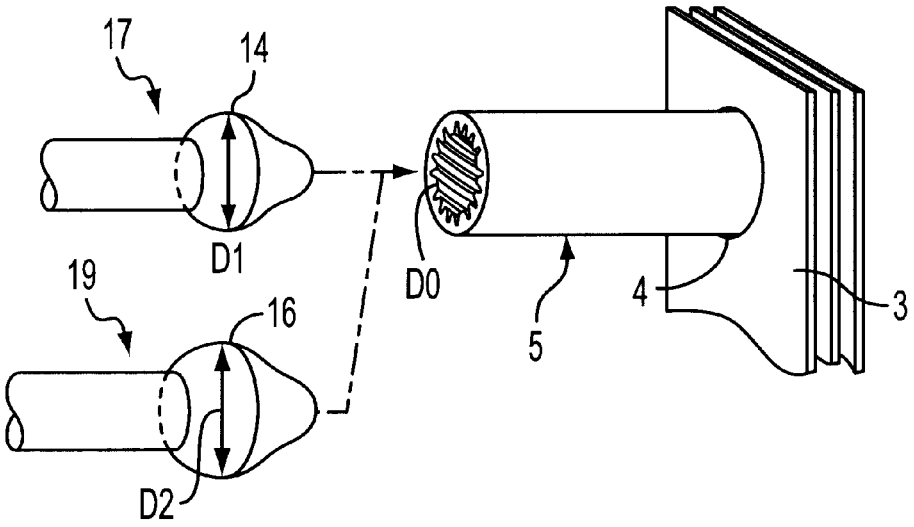
FIG. 7 is an explanatory view of an alternative method of manufacture showing expanding a heat exchanger tube.

FIG. 7 explains an alternative manufacturing method including a different way of expanding a heat exchanger tube. In this case, two expanding jigs 17, 19 are used. First expanding jig 17 has a small expanding portion 14 located at the tip of it which has the diameter D1 that is slightly larger than the inner diameter D0 of heat exchanger tube 5 before it is expanded. The second expanding jig 19 has a large expanding portion 16 located at the tip of it which has a diameter D2 that is larger than the diameter D1 of small expanding portion 14. To expand, small expanding portion 14 of first expanding jig 17 is inserted into inner fin tube 5. Then, first expanding jig 17 is removed from inside inner finned hast exchanger tube 5. After removing first expanding jig 17, large expanding portion 16 of second expanding jig 19 is also inserted into inner fin tube 5 which has been expanded by first expanding jig 17. This expanding method can achieve the same result as that achieved by the first described expanding method using one expanding jig 15.

Figure 8:
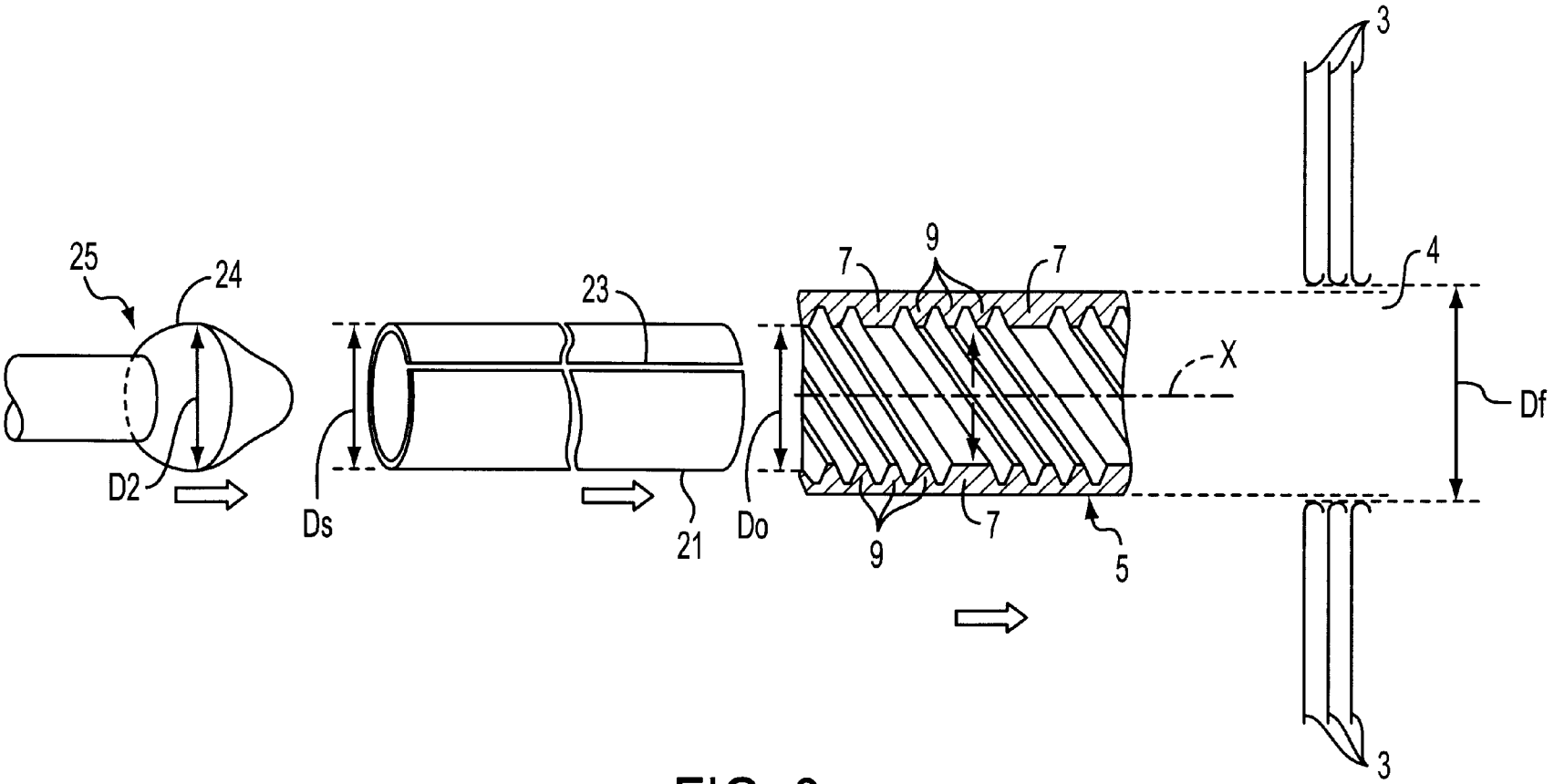
FIG. 8 is an explanatory view of an alternative method of manufacture showing expanding a heat exchanger tube.

FIG. 8 is an explanatory view illustrating another method for expanding a heat exchanger tube. In this embodiment, the expanding is carried out once, thus this method is very efficient. In this method, a stainless steel sleeve 21 having a slit 23 and sleeve expanding jig 25 are used. Before expansion begins, the outer diameter of stainless steel sleeve 21 is smaller than D0 which is the inner diameter of tube 5. Sleeve expanding jig 25 is the same as large expanding jig 19 shown in FIG. 7. Tube expanding portion 24 having the diameter D2 is provided at the tip of sleeve expanding jig 25.

First, a plurality of plate fins 3 are stacked with narrow space therebetween so that holes 4 of each plate fin 3 are aligned with one another. The diameter Df of each hole is larger than D0 which is the diameter of inner fin heat exchanger tube 5. Then, tube 5 are inserted into holes 4. After that, stainless steel sleeve 21 is inserted into tube 5. It is easy to insert because the outer diameter Ds of stainless steel sleeve 21 is smaller than the inner diameter D0 of inner fin heat exchanger tube 5. Then, sleeve expanding jig 25 is inserted into stainless steel sleeve 21 already positioned inside of tube 5. The expanding force caused by inserting jig 25 is applied to the inside of tube 5 in the radial direction as shown by the arrows in FIG. 8. Therefore, inner fin heat exchanger 5 can be uniformly expanded in longitudinal direction X without a deformation and a buckling of inner fins 9.

Figure 9:
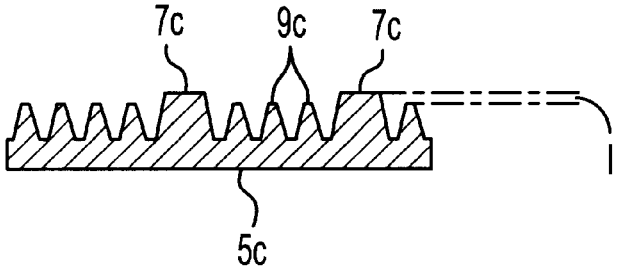
FIG. 9 is a schematic view of an alternative embodiment of a heat exchanger tube wherein the convex portions are higher than the fins. In this view, the tube has been "uncurled" for easier viewing.

FIG. 9 is a schematic view of an alternative embodiment of a heat exchanger tube wherein the convex portions are higher than the fins. In this view, the tube has been "uncurled" for easier viewing. In this embodiment, the tube is denoted by reference numeral 5*c*. The inner fins are denoted by 9*c* and the convex portions are denoted by 7*c*. In tube 5*c*, convex portion 7*c* is formed so as to be slightly higher, by a distance l than inner fins 9*c*. Therefore, when this inner heat exchanger tube 5*c* is expanded, the force caused by expanding portions 11 and 13 in FIG. 5, expanding portions 14 and 16 in FIG. 7, stainless steal sleeve 21 in FIG. 8, pushes only on convex portion 7*c*, and does not push against inner fins 9*c*. Consequently, inner fins 9*c* are not damaged during expansion. In this embodiment, as with the previously described embodiment, the ratio (h/di) of the height, or depth, (h) of inner fins 9*c* to the mean inner diameter (di) which is the distance between the center of inner fin 9*c* and the center of inner fin 9*c* located at opposite side is set so as to be more than 0.035.

Figure 10:
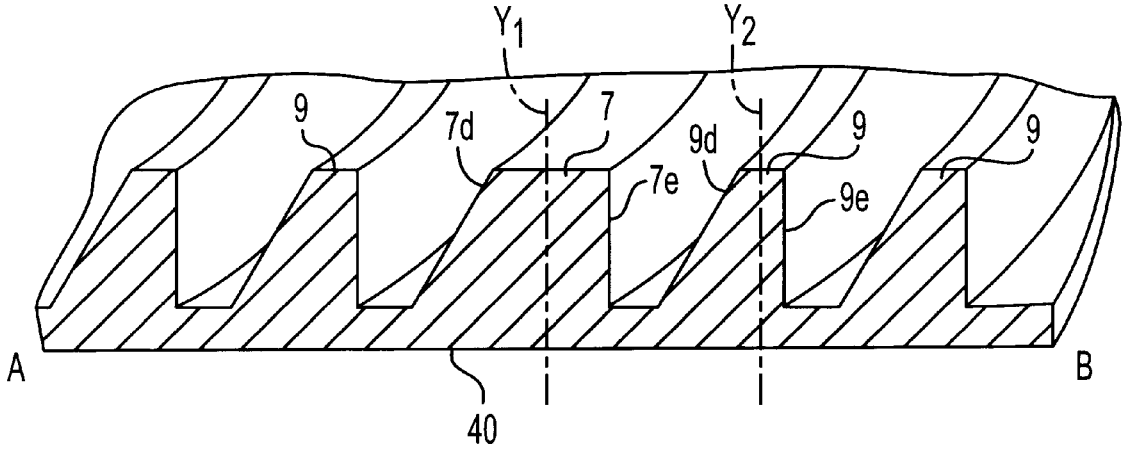
FIG. 10 is a cross sectional view of an alternative embodiment of a heat exchanger tube in which each inner fins has a unsymmetrical shape.
Figure 11:
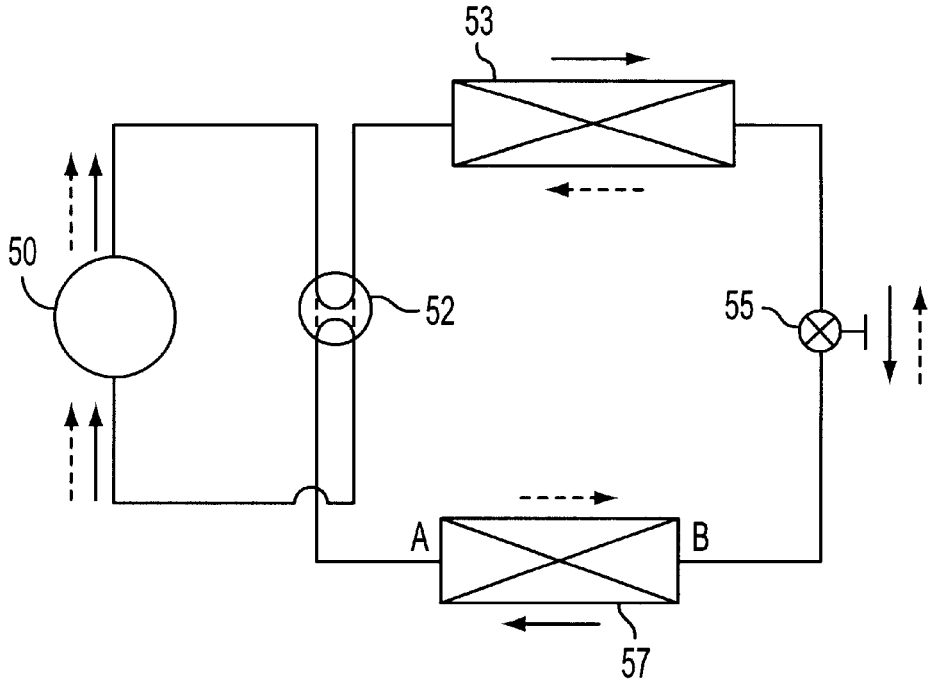
FIG. 11 is a block diagram of a refrigerating circuit including heat exchangers according to the present invention.
Figure 12:
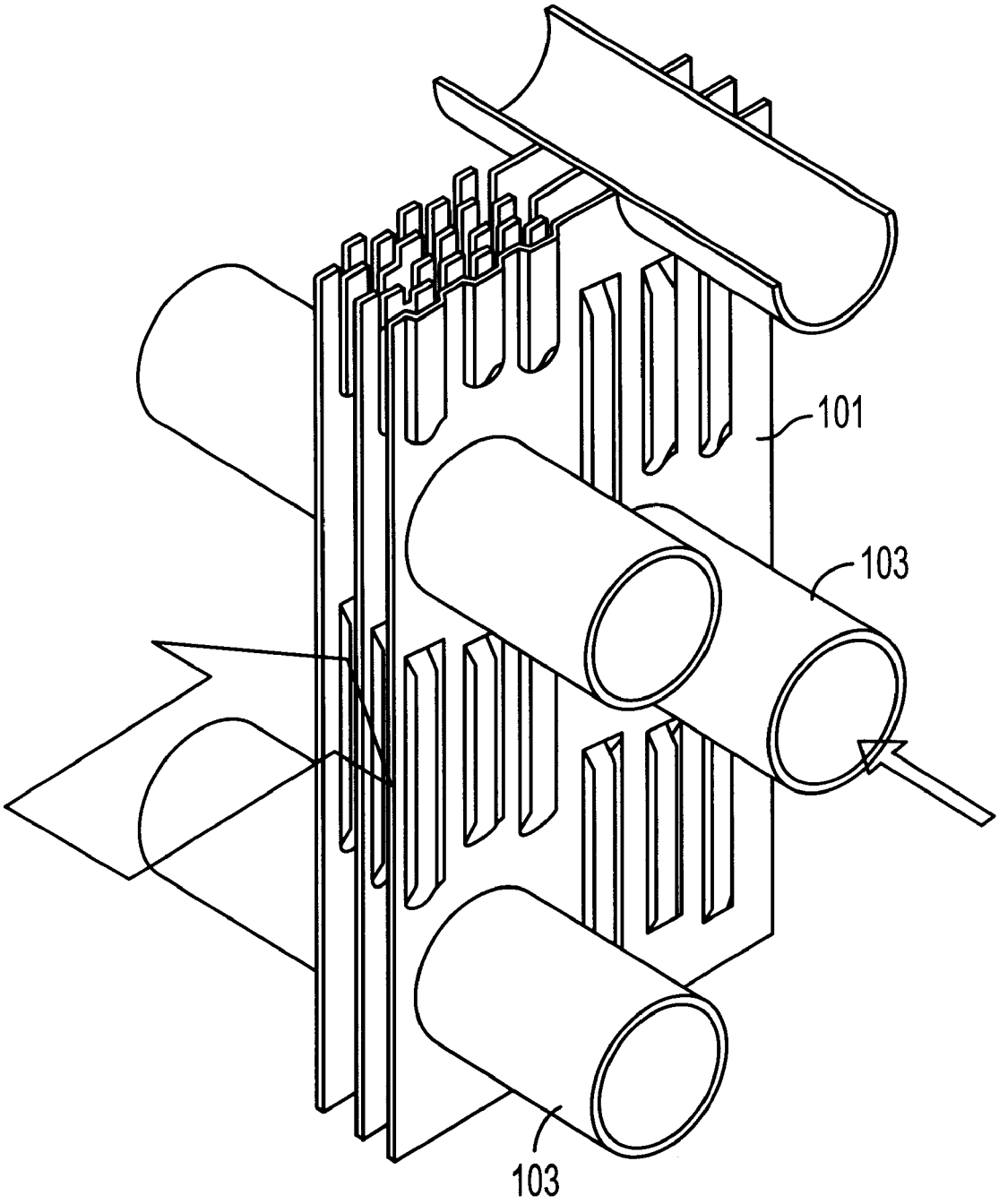
FIG. 12 PRIOR ART
FIG. 12 (Prior Art) is a perspective view showing a portion of a known heat exchanger.
Figure 13:
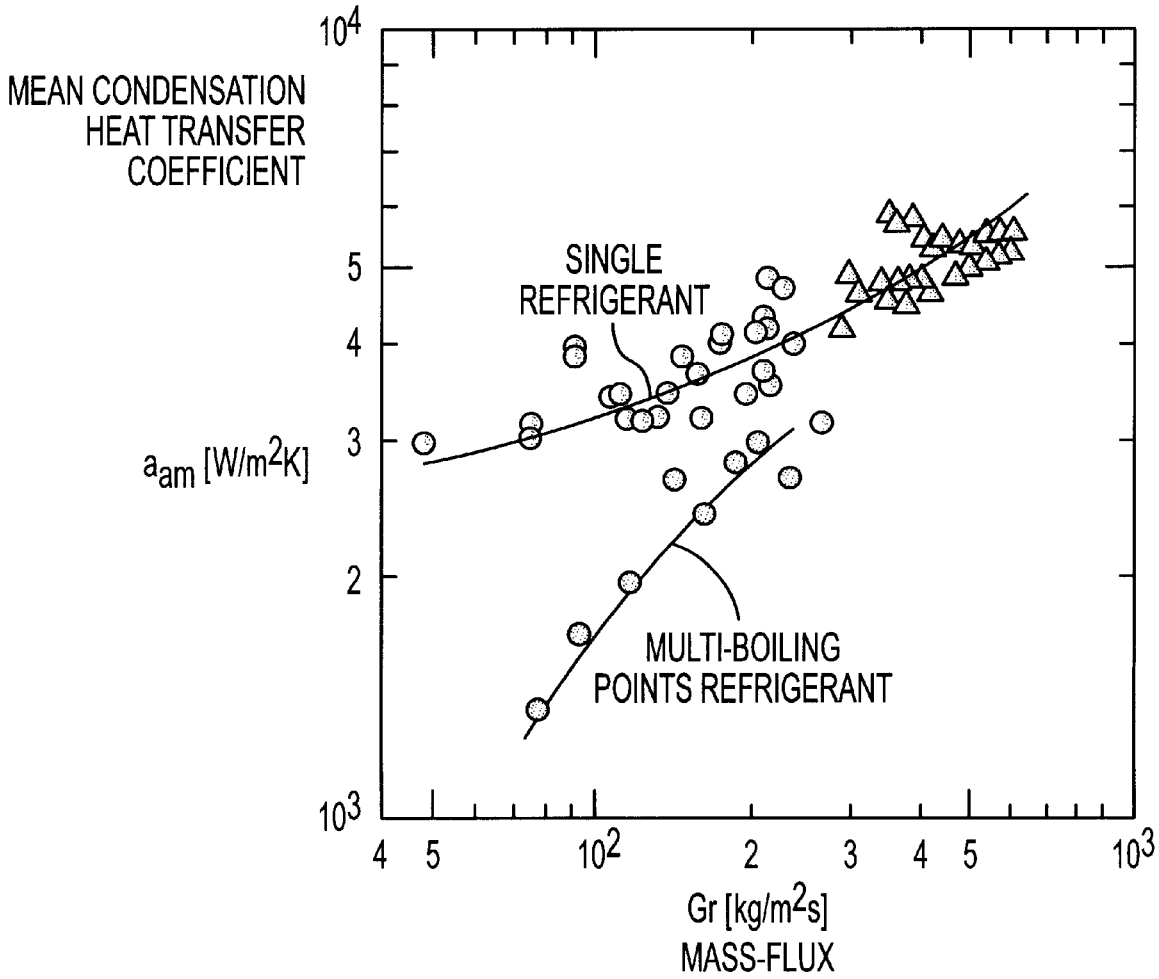
FIG. 13 is a graph showing a relationship between a mean condensation heat transfer coefficient and mass-flux of refrigerants.
Figure 14:
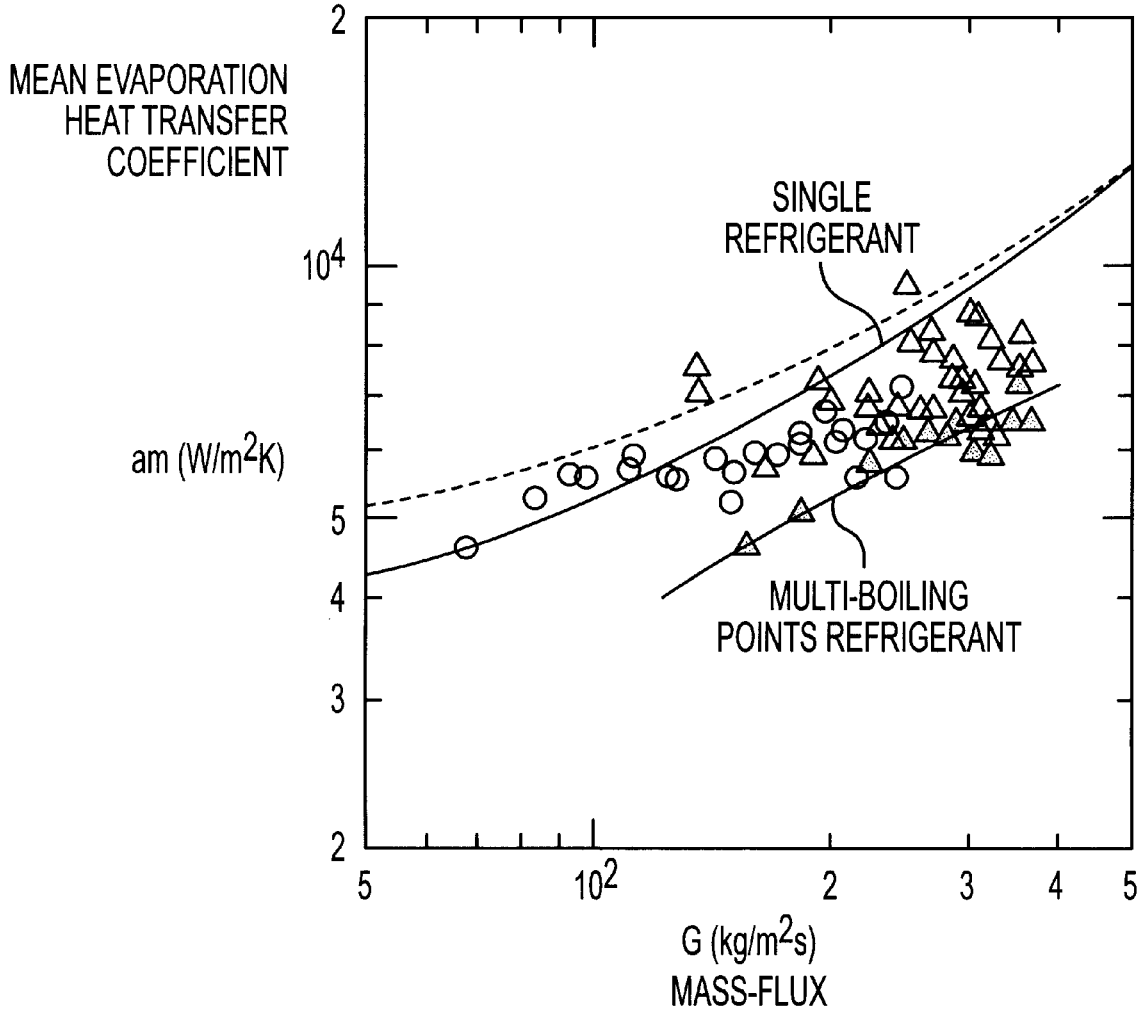
FIG. 14 is a graph showing a relationship between a mean evaporation heat transfer coefficient and mass-flux of refrigerants.
Figure 15:
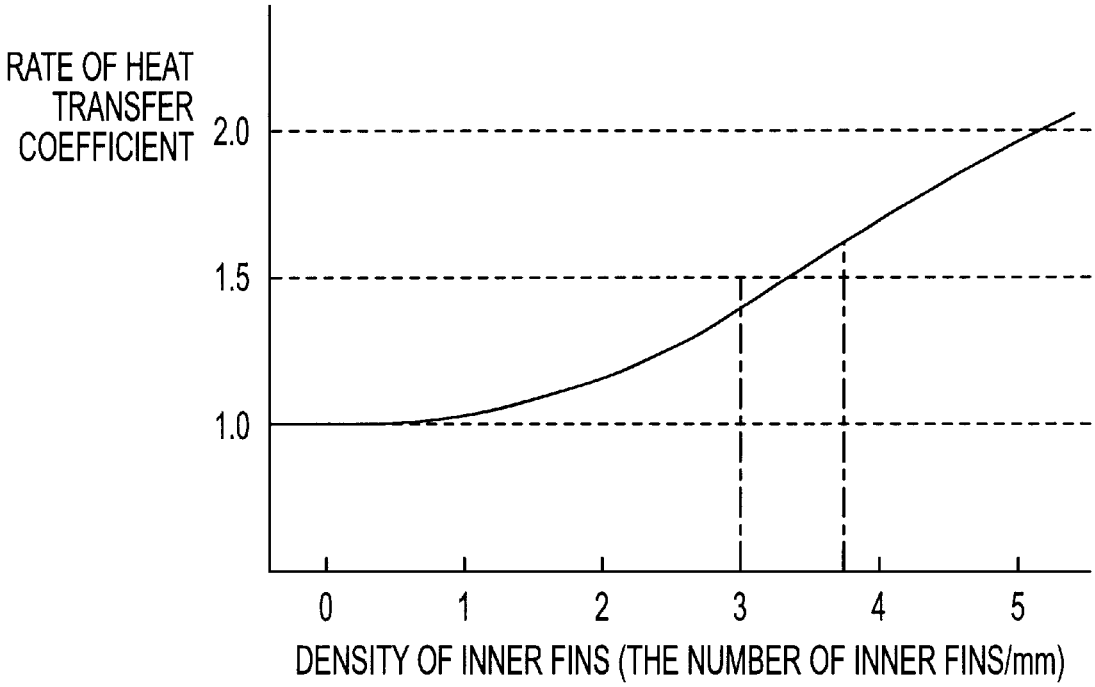
FIG. 15 is a graph showing a relationship between a density of inner fins, which is defined as the number of inner fins divided by the length of inner circumference of a heat exchanger tube, and a rate of heat transfer coefficient.

Another modification of inner fin heat exchanger tube which is especially suitable for a heat exchanger used in zeotropic refrigerant will be explained referring to FIGS. 10 and 11. FIG. 10 is a cross section of the heat exchange tube, and FIG. 11 is a block diagram of a refrigerating circuit including heat exchangers according to the present invention.

In this embodiment, the inner fin heat exchanger tube is referred to by reference numeral 40. The cross-sectional shapes of convex portions 7 and inner fins 9 have slope sides 7*d*, 9*d* and straight sides 7*e* and 9*e*. That is to say the cross-sectional shapes of convex portions 7 and inner fins 9 are asymmetric shape along center lines Y1 and Y2, respectively.

In this configuration, the flow resistance when refrigerant flow in tube 40 is from A to B is smaller than when the refrigerant flow is in the opposite direction, from B to A. However, the heat exchanger using this inner fin heat exchanger tubes 40 has a higher heat transfer rate when refrigerant flows from A to B than when it flows in the opposite direction, from B to A because a chaotic current of the refrigerant is caused by straight side 7*e,* 9*e*.

On the other hand, in a heat pump type air conditioner which operates in either a cooling or a heating mode, by changing direction of refrigerant flow, a heat exchanger operates in one mode as an evaporator and in the other as a condenser. When operating as a condenser, refrigerant flow rate is high. Therefore an increased flow resistance causes a loss of pressure. Conversely, when operating as an evaporator, refrigerant flow is relatively slow and there is little effect of flow resistance on pressure. Therefore, the heat exchanger should be connected into the refrigerating circuit so that the inlet of the heat exchanger which uses an inner fin heat exchanger tube such as tube 40 in FIG. 10, when the heat exchanger functions as condenser is the A side, and the inlet of the heat exchanger when the heat exchanger functions as evaporator is the B side. Connected in this manner, the heat exchanger should perform with a high heat transfer rate in both mode.

In FIG. 11, heat exchanger 57 uses inner fin heat exchanger tubes such as tube 40 shown in FIG. 10. Heat exchanger 57 is an indoor heat exchanger of a heat pump type air conditioner system. The refrigerating circuit comprises a compressor 50, a four-way valve 52, outdoor heat exchanger 53, an expansion valve 55 and indoor heat exchanger 57. Indoor heat exchanger 57 uses a plurality of inner fin heat exchanger tubes 40. Tubes 40 are connected so that slope sides 7*d*, 9*d* of convex portions 7 and inner fins 9, respectively face the same direction with respect to the flow direction of the refrigerant passing through inside inner fin heat exchanger tube 40. The A side of tube 40 is connected to four-way valve 52, and B side of tube 40 is connected to expansion valve 55.

This circuit shown in FIG. 11 can operate in either a cooling (air conditioning) mode to cool a room or in a heating (heat pump) mode to heat a room. Mode switching is achieved by operating four way valve 52 and reversing the flow direction of refrigerant. The solid line arrows in FIG. 11 show the flow direction of the refrigerant during cooling mode operation. The dotted line arrows show the flow direction of the refrigerant during heating mode operation.

In the cooling mode, the refrigerant discharged from compressor 50 passes through four-way valve 52, and the refrigerant is then supplied to outdoor heat exchanger 53, where it is gives off heat to the outside air. Thus, the refrigerant passing through expansion valve 55 has been condensed in outdoor heat exchanger 53. Condensed refrigerant flows through expansion valve 55 and is supplied to indoor heat exchanger 57. The refrigerant receives heat so as to cool the indoors space. Thus, indoor heat exchanger 57 operates as an evaporator. Evaporated refrigerant flows again through four way valve 52 back to compressor 50.

In heating mode, the direction of flow of the refrigerant is reversed by changing four-way valve. In this mode indoor heat exchanger 57 gives up heat to the indoors and therefore operates as a condenser. Condensed refrigerant flows through expansion valve 55 to the outdoor heat exchanger 53. At heat exchanger 53, refrigerant receives heat from the outside and the refrigerant evaporates and then returns to compressor 50 via four-way valve 52.

During heating mode operation, when heat exchanger 57 operates as a condenser, refrigerant flows from A side to B side of tubes 40. Thus, indoor heat exchanger 57 operates with high capacity and has a high heat transfer rate. In cooling mode, when heat exchanger 57 functions as an evaporator, refrigerant flows from B side to A side in inner fin heat exchanger tubes 40. Therefore, indoor heat exchanger 57 also operates at high capacity and with a high heat transfer rate.

In the manufacture of tube 40, when the tube is expanded by expanding portions 11 and 13 in FIG. 5, expanding portions 14 and 16 in FIG. 7 or expanding portion 24 and stainless steal sleeve 21 in FIG. 8, the expanding jig is inserted from the direction A to the direction B. This helps to prevent a deformation and a buckling by inserting the expanding jigs in this direction.

Many changes and modifications in the above described embodiment can be carried out without departing from the scope of general inventive concept as defined by the appended claims and their equivalents.

What is claimed is:

1. A heat exchanger tube in which a refrigerant flows comprising a tube wall configured so as to have an outer surface;

an inner surface having a convex portion having a tip which has a predetermined area, and a plurality of inner fins each having a tip, the area of the tip of the convex portion being larger than that of the tip of the inner fins, wherein the cross-sectional shapes of the convex portion and the inner fins are asymmetrical so that the flow resistances are different for different flow directions of a refrigerant through the tube.

2. A heat exchanger tube according to claim 1, wherein a ratio between the height of the inner fins, which is the distance from the tip of the inner fin to the inner surface of the heat exchanger tube, and a mean inner diameter of the heat exchanger tube, which is the distance between the center of the inner fin and the center of inner fin located at an opposite side of the tube through the center thereof, is greater than 0.035.

3. A heat exchanger tube according to claim 1, wherein the height of the convex portion is more than that of the inner fin.

4. A heat exchanger tube according to claim 1, wherein the convex portion and the inner fins are formed as a spiral along inside of the heat exchanger tube, the spiral having a predetermined helix angle.

5. A heat exchanger tube according to claim 4, wherein the helix angle is equal to or greater than 30°.

6. A heat exchanger for refrigerating circuit comprising:

a plurality of plate fins, each having a hole therein; and a heat exchanger tube passing through the holes of the plate fins, the heat exchanger tube having a tube wall configured so as to have an outer surface and an inner surface, said inner surface having a convex portion having a tip which has a predetermined area, and a plurality of inner fins each having a tip, the area of the tip of the convex portion being larger than that of the tip of the inner fins, wherein the cross-sectional shapes of the convex portion and the inner fins are asymmetrical so that the flow resistances are different for different flow directions of a refrigerant through the tube.

7. A heat exchanger according to claim 6, wherein the convex portion and the inner fins are formed as a spiral along inside of the heat exchanger tube, the spiral having a predetermined helix angle.

8. A heat exchanger according to claim 6, wherein the helix angle is equal to or greater than 30°.

9. A refrigerating circuit comprising:

a compressor for compressing a refrigerant flowing in the refrigerating circuit;

at least two heat exchangers for heat exchanging between the refrigerant and fluids external to the refrigerating circuit; and a expansion valve connected between the heat exchangers, at least one of the heat exchangers comprising:

a plurality of plate fins, each having a hole therein; and a heat exchanger tube passing through the holes of the plate fins, the heat exchanger tube having a tube wall configured so as to have an outer surface and an inner surface, said inner surface having a convex portion having a tip which has a predetermined area, and a plurality of inner fins each having a tip, the area of the tip of the convex portion being larger than that of the tip of the inner fins, wherein the cross-sectional shapes of the convex portion and the inner fins are asymmetrical so that the flow resistances are different for different flow directions of a refrigerant through the tube.

10. A refrigerating circuit according to claim 9, wherein the convex portion and the inner fins are formed as a spiral along inside of the heat exchanger tube, the spiral having a predetermined helix angle.

11. A refrigerating circuit according to claim 10, wherein the helix angle is equal to or greater than 30°.

12. A refrigerating circuit according to claim 9, wherein the refrigerant is a zeotropic refrigerant.

13. A refrigerating circuit as in claim 9, further comprising a flow direction changing device which changes a direction of flow of refrigerant in the refrigerating circuit in accordance with a heating mode or a cooling mode; and wherein in the heating mode, the flow resistance of the heat exchanger tube passing through the heat exchanger and functioning as an evaporator is low and wherein in the cooling mode, the flow resistance of the heat exchanger tube passing through the heat exchanger functioning as a condenser is high.

14. A refrigerating circuit comprising:

a compressor for compressing a refrigerant flowing in the refrigerating circuit;

at least two heat exchangers for heat exchanging between the refrigerant and fluids external to the refrigerating circuit; and an expansion valve connected between the heat exchangers, at least one of the heat exchangers comprising:

a plurality of plate fins, each having a hole therein; and a heat exchanger tube passing through the holes of the plate fins, the heat exchanger tube having a tube wall configured so as to have an outer surface and an inner surface, said inner surface having a convex portion having a tip which has a predetermined area, and a plurality of inner fins each having a tip, the area of the tip of the convex portion being larger than that of the tip of the inner fins, wherein a ratio between the height of the inner fins, which is the distance from the tip of the inner fin to the inner surface of the heat exchanger tube, and a mean inner diameter of the heat exchanger tube, which is the distance between the center of the inner fin and the center of inner fin located at an opposite side of the tube through the center thereof, is greater than 0.035, wherein the refrigerant is a zeotropic refrigerant, and further comprising a flow direction changing device which changes a direction of flow of refrigerant in the refrigerating circuit in accordance with a heating mode or a cooling mode;

wherein in the heating mode, the flow resistance of the heat exchanger tube passing through the heat exchanger and functioning as an evaporator is low and wherein in the cooling mode, the flow resistance of the heat exchanger tube passing through the heat exchanger functioning as a condenser is high.

15. A refrigerating circuit comprising:

a compressor for compressing a refrigerant flowing in the refrigerating circuit;

at least two heat exchangers for heat exchanging between the refrigerant and fluids external to the refrigerating circuit; and an expansion valve connected between the heat exchangers, at least one of the heat exchangers comprising:

a plurality of plate fins, each having a hole therein; and a heat exchanger tube passing through the holes of the plate fins, the heat exchanger tube having a tube wall configured so as to have an outer surface and an inner surface, said inner surface having a convex portion having a tip which has a predetermined area, and a plurality of inner fins each having a tip, the area of the tip of the convex portion being larger than that of the tip of the inner fins, wherein the convex portion and the inner fins are formed as a spiral along the inside of the heat exchanger tube, the spiral having a predetermined helix angle, the helix angle being equal to or greater than 30°, and wherein the refrigerant is a zeotropic refrigerant;

and further comprising a flow direction changing device which changes a direction of flow of refrigerant in the refrigerating circuit in accordance with a heating mode or a cooling mode;

wherein in the heating mode, the flow resistance of the heat exchanger tube passing through the heat exchanger and functioning as an evaporator is low and wherein in the cooling mode, the flow resistance of the heat exchanger tube passing through the heat exchanger functioning as a condenser is high.

* * * * *